US005927075A

United States Patent [19]

Khair

[11] Patent Number: 5,927,075

[45] Date of Patent: Jul. 27, 1999

[54] METHOD AND APPARATUS FOR EXHAUST GAS RECIRCULATION CONTROL AND POWER AUGMENTATION IN AN INTERNAL COMBUSTION ENGINE

[75] Inventor: Magdi K. Khair, San Antonio, Tex.

[73] Assignee: Turbodyne Systems, Inc., Carpinteria, Calif.

[21] Appl. No.: 08/870,633

[22] Filed: Jun. 6, 1997

[51] Int. Cl.[6] ..... F02B 33/44

[52] U.S. Cl. ..... 60/605.2; 123/565

[58] Field of Search ..... 123/565; 60/605.2, 60/608, 278

[56] References Cited

U.S. PATENT DOCUMENTS

| | | | |
|---|---|---|---|
| 3,941,035 | 3/1976 | Mueller | 92/49 |
| 4,215,550 | 8/1980 | Dinger | 60/606 |
| 4,373,498 | 2/1983 | Ushimura | 123/571 |

(List continued on next page.)

FOREIGN PATENT DOCUMENTS

| | | | |
|---|---|---|---|
| 606244 | 10/1960 | Canada . | |
| 0 596 855 A1 | 10/1993 | European Pat. Off. | F02B 37/00 |
| 40 07516 A1 | 9/1991 | Germany | F01N 3/02 |
| 60-184918 | 9/1985 | Japan | F01N 3/02 |
| 1437171 | 5/1976 | United Kingdom | F02B 37/04 |
| WO 95/23280 | 8/1995 | WIPO | F01N 3/02 |
| WO 96/30635 | 10/1996 | WIPO | F02B 37/04 |

OTHER PUBLICATIONS

International Search Report dated Aug. 26, 1998, Patent Cooperation Treaty, Intl. Appln. PCT/US98/11672.

"Service Manual for Low Emission 3208 Engine with Exhaust Gas Recirculation," Serial No. 4031–Up, *Caterpillar*, Sep. 1976 (28 pages).

Turbodyne Brochure, "Performance for Your Engine and the Environment," 11 pages, undated.

Magdi K. Khair, "Progress in Diesel Engine Emissions Control," presented at the ASME Energy–Sources Technology Conf. and Exhibition–Jan. 26–30, 1992, Houston, Texas, *The American Society of Mechanical Engineers*, 11 pages.

Research http://www.epa.gov/docs/Press Releases/1996/June/Day–21/pr–739.html, Environmental Protection Agency, "EPA Proposes Plan for Reducing Ozone Polution from Heavy Trucks," 1 page–double sided.

Reprinted from *Federal Registry*, Environmental Protection Agency, 40 CFR Part 86, "Control of Emissions of Air Pollution from Highway Heavy–Duty Engines," Notice of Proposed Rulemaking, pp. 1–95; Draft Regulatory Text –pp. 1–42; Fig. 1–8 re: National NOx Emissions Projections/Graphs, 4 pages–double sided.

*Primary Examiner*—Andrew M. Dollnar
*Assistant Examiner*—Arnold Castro
*Attorney, Agent, or Firm*—Baker & Botts, L.L.P.

[57] ABSTRACT

A system for controlling exhaust gas recirculation flow rates and power augmentation of a turbocharged internal combustion engine operating on diesel fuel or other fuels. Exhaust gas from the engine's exhaust manifold is used to drive the turbocharger. Exhaust gas exiting from the turbocharger is directed through a filter trap. A first portion of the exhaust gas exiting the filter trap flows through an exhaust gas recirculation cooler to provide a first input to an electronically controlled diverter valve. Filtered intake air is supplied as a second input to the electronically controlled diverter valve. A mixed output of intake air and recirculated exhaust gas is directed from the diverter valve to an electrically driven compressor and then to the intake manifold of the diesel engine. The combination of the electronically controlled diverter valve and the electrically driven compressor controls both the exhaust gas recirculation flow rates and smoke limited power output at speeds below the peak torque speed of the associated engine. Above peak torque speeds, the turbocharger generally supplies all required intake air to the engine and the electrically driven compressor supplies only recirculated exhaust gas to control $NO_x$ emissions from the engine.

20 Claims, 2 Drawing Sheets

U.S. PATENT DOCUMENTS

| | | | |
|---|---|---|---|
| 4,466,248 | 8/1984 | Nartowski | 60/602 |
| 4,474,008 | 10/1984 | Sakurai et al. | 60/605 |
| 4,885,911 | 12/1989 | Woollenweber et al. | 60/597 |
| 4,945,870 | 8/1990 | Richeson | 123/90.11 |
| 4,958,497 | 9/1990 | Kawamura | 60/608 |
| 5,038,566 | 8/1991 | Hara | 60/608 |
| 5,123,397 | 6/1992 | Richeson | 123/568 |
| 5,168,706 | 12/1992 | Kawamura | 60/608 |
| 5,284,116 | 2/1994 | Richeson, Jr. | 123/425 |
| 5,297,515 | 3/1994 | Gale et al. | 123/3 |
| 5,353,776 | 10/1994 | Burrahm et al. | 123/700 |
| 5,426,936 | 6/1995 | Levendis et al. | 60/278 |
| 5,440,880 | 8/1995 | Ceynow et al. | 60/605.2 |
| 5,499,605 | 3/1996 | Thring | 123/70 R |
| 5,524,599 | 6/1996 | Kong et al. | 123/682 |
| 5,560,208 | 10/1996 | Halimi et al. | 60/608 |
| 5,605,045 | 2/1997 | Halimi et al. | 60/607 |
| 5,617,726 | 4/1997 | Sheridan et al. | 60/605.2 |
| 5,657,630 | 8/1997 | Kjemtrup | 60/605.2 |
| 5,771,868 | 6/1998 | Khair | 123/570 |

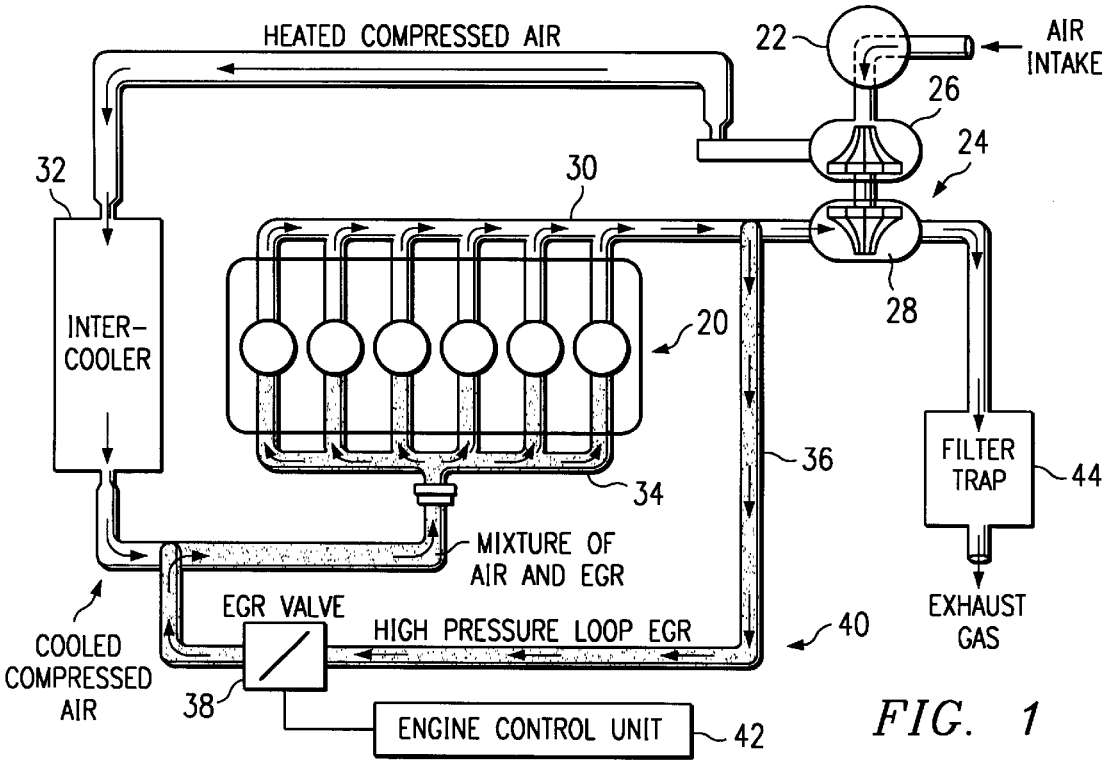
FIG. 1
FIG. 2
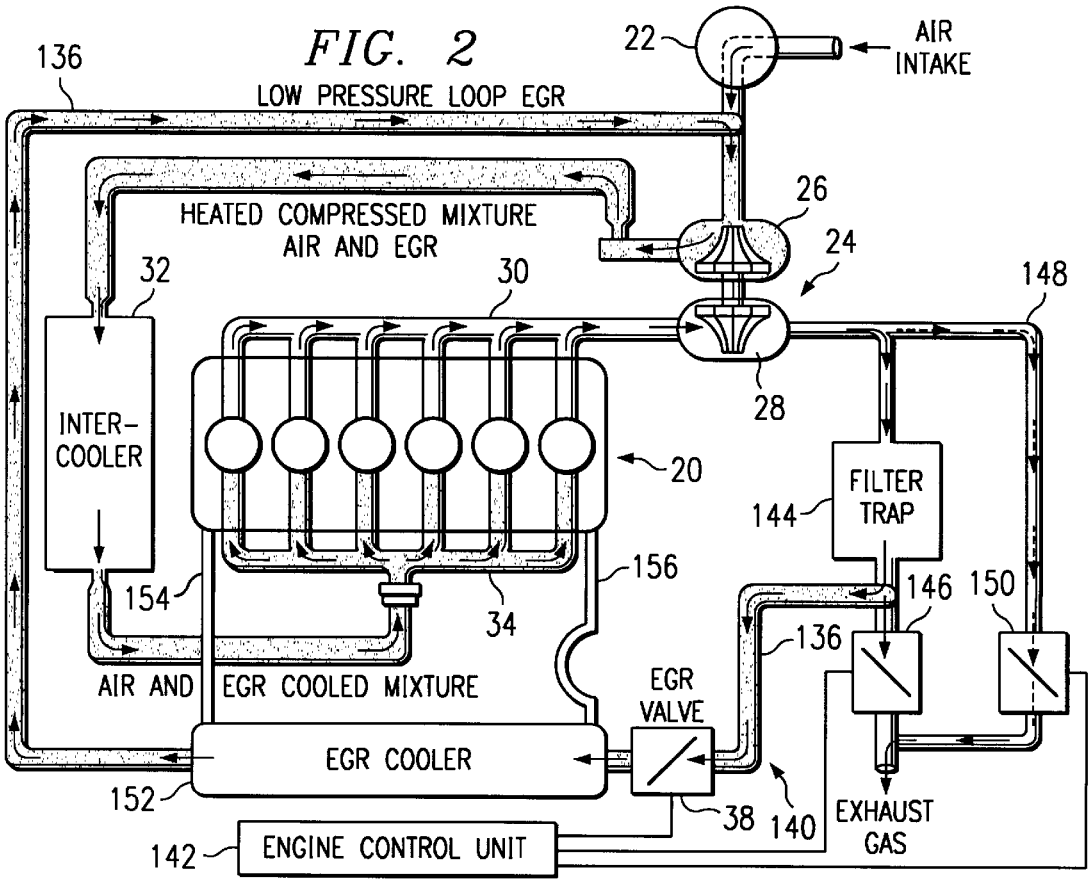

METHOD AND APPARATUS FOR EXHAUST GAS RECIRCULATION CONTROL AND POWER AUGMENTATION IN AN INTERNAL COMBUSTION ENGINE

TECHNICAL FIELD OF THE INVENTION

This invention relates generally to apparatus and methods for recirculation of exhaust gas in an internal combustion engine. More particularly, but not by way of limitation, this invention relates to using an electronically controlled diverter valve and an electrically driven compressor in combination with exhaust gas recirculation to reduce undesirable gas and particulate emissions from an internal combustion engine such as a diesel engine.

BACKGROUND OF THE INVENTION

Proposed federal and state regulations on controlling emissions from internal combustion engines generally call for reductions in nitrogen oxide ($NO_x$) while keeping particulate emissions at or below current levels. Representatives of the diesel engine industry and regulatory agencies previously signed a Statement Of Principles which calls for $NO_x$ emissions of 2.5 grams per brake hose power-hour (g/bhp-hr) or less and particulate matter emissions of 0.10 g/bhp-hr or less by the year 2004. The U.S. Environmental Protection Agency (EPA) has proposed new regulations based on the Statement of Principles. The EPA issued a notice of proposed rule making entitled *Control of Emissions of Air Pollution from Highway Heavy-duty Engines* (61 F.R. 33421, Jun. 27, 1996) with proposed changes to 40 C.F.R. Part 86.

In the past significant progress has been achieved in reducing diesel engine emissions by various changes in engine design and fuel system design. Fuel improvements and exhaust after treatment techniques have also been used to meet the challenge of lower allowable levels of engine exhaust emissions. At the same time, customers are demanding greater fuel efficiency and extended engine life with less maintenance requirements. As a result, several difficult design tradeoffs must often be made to meet these sometimes conflicting goals. For example reducing $NO_x$ emission from a diesel engine by retarding injection timing may have a negative impact upon fuel economy. Also, design changes made to reduce particulate emissions may increase $NO_x$ emissions and vice versa. The task of maintaining good fuel economy is especially difficult with the need to control $NO_x$ and particulate emissions at the new, proposed relatively low levels in comparison with prior acceptable standards. A paper entitled Progress in *Diesel Engine Emissions Control* by Magdi K. Khair was presented at the ASME Energy-Sources Technology Conference and Exhibition during January 1992 in Houston and provided a summary of previous changes made to improve performance while reducing emissions from diesel engines.

Two technologies, when combined, hold promise in helping heavy-duty diesel engine designers meet the future EPA emission regulations. Exhaust gas recirculation (EGR), a technology used for some time in light-duty diesel engines, has been effective in reducing $NO_x$ emissions to levels approaching those proposed by the new regulation. Exhaust gas recirculation reduces $NO_x$ in diesel engines by diluting the oxygen induced with the fresh charge air as well as acting as a heat sink in the combustion process. A serious consequence of this approach is an increase in insoluble particulate matter (primarily soot).

Exhaust gas after treatment for diesel engines by filter traps have proven to be effective for some applications in dealing with insoluble particulate matter. Diesel exhaust after treatment has traditionally been characterized by high cost and low reliability. Recent developments in passively regenerated filter traps using fuel additive catalyzing agents have emerged as a lower cost alternative to conventional active regeneration filter trap systems.

Several diesel engine manufacturers have experimented with EGR and passive filter trap technology and successfully reduced $NO_x$ emission to approximately 2.0 g/bhp-hr or less while obtaining extremely low particulate matter emissions. Lab demonstrations have shown that these two technologies allowed several diesel engines to meet the EPA proposed model year 2004 heavy-duty diesel engine exhaust emissions standards.

SUMMARY OF THE INVENTION

In accordance with teachings of the present invention, methods and apparatus for internal combustion engine exhaust gas recirculation control and power augmentation are provided to substantially reduce or eliminate disadvantages and problems associated with previous exhaust gas emission control systems for such engines.

One aspect of the present invention includes a system for exhaust gas recirculation control and power augmentation in a turbocharged diesel engine having an electronically controlled diverter valve and an electrically driven compressor. Exhaust gas from the diesel engine's exhaust manifold is preferably used to drive a conventional turbocharger. All exhaust gas exiting from the turbocharger is preferably routed through a filter trap and then split into two portions. A first portion of the filtered exhaust gas flows back through an exhaust gas recirculation cooler to provide a first input to the electronically controlled diverter valve. A second input to the electronically controlled diverter valve is supplied directly from an intake air filter. The electronically controlled diverter valve provides a mixed output of intake air and recirculated exhaust gas which is supplied to the inlet of the electrically driven compressor and then discharged into the intake manifold of the associated diesel engine. The ratio of intake air and recirculated exhaust gas in the output from the electronically controlled diverter valve may be determined by air flow requirements to maintain optimum air/fuel ratios for efficient engine performance and required exhaust gas recirculation flow rates to reduce $NO_x$ emissions based on current engine operating conditions. The combination of the electronically controlled diverter valve and the electrically driven compressor controls both exhaust gas recirculation rates and intake air augmentation to raise smoke limited power output at speeds below the peak torque speeds of the associated diesel engine. Above the peak torque speed, a standard turbocharger may be used to maintain optimum air/fuel ratios for efficient engine performance. The electronically controlled diverter valve and the electrically driven compressor will generally only be used to maintain low levels of exhaust emission when the diesel engine is operating at speeds below the associated peak torque speed, and specifically during acceleration conditions.

Technical advantages of the present invention include providing an exhaust gas recirculation control and power augmentation system wherein all exhaust gas will flow through a filter trap prior to recirculating a portion of the exhaust gas which results in reduced engine wear and substantially particulate free emissions from the associated engine. The exhaust gas recirculation control and power augmentation system combines the functions of exhaust gas recirculation and conditioning of intake air-(intake manifold temperature control) along with control of engine power augmentation at speeds below the associated peak torque speed. The exhaust gas recirculation control and power augmentation system overcomes low exhaust gas pressure by using an electrically driven compressor to supply cool, filtered, recirculated exhaust gas to the intake manifold which is typically at a higher pressure than exhaust gas exiting from the associated filter trap. An exhaust gas recirculation control and power augmentation system incorporating teachings of the present invention provides reduced nitrogen oxide ($NO_x$) emissions through exhaust gas recirculation and reduced particulate emissions by preferably using a filter trap to remove carbon particles and soot from the exhaust gas. Both continuous regeneration filter traps (sometimes referred to as "passive filter traps") and periodic regeneration filter traps (sometimes referred to as "active filter traps") may be satisfactorily used with the present invention.

Further technical advantages of the present invention include providing an exhaust gas recirculation control and power augmentation system for heavy-duty turbocharged diesel engines which are particularly effective in reducing undesirable gas emissions and particulate (soot) emissions at speeds both above and below the associated peak torque speed for the diesel engine. The present invention results in maintaining good fuel economy while at the same time allowing substantial reductions in $NO_x$ emissions and particulate matter emissions from the associated diesel engine. Combining an electronically controlled diverter valve with an electrically driven compressor in accordance with teachings of the present invention allows the use of exhaust gas recirculation to provide optimum air/fuel ratios at low engine speeds to control black smoke as increasing loads are placed on the associated diesel engine, as well as during acceleration conditions by overcoming any lag time in response of an associated turbocharger.

BRIEF DESCRIPTION OF THE DRAWINGS

For a more complete understanding of the present invention and the advantages thereof, reference is now made to the following descriptions taken in conjunction with the accompanying drawings, in which:

FIG. 1 is a schematic drawing showing a block diagram of various components associated with a typical heavy-duty turbocharged diesel engine having a high pressure loop exhaust gas recirculation system;

FIG. 2 is a schematic drawing showing a block diagram of various components associated with a typical heavy-duty turbocharged diesel engine having a low pressure loop exhaust gas recirculation system;

DETAILED DESCRIPTION OF THE INVENTION

Figure 3:
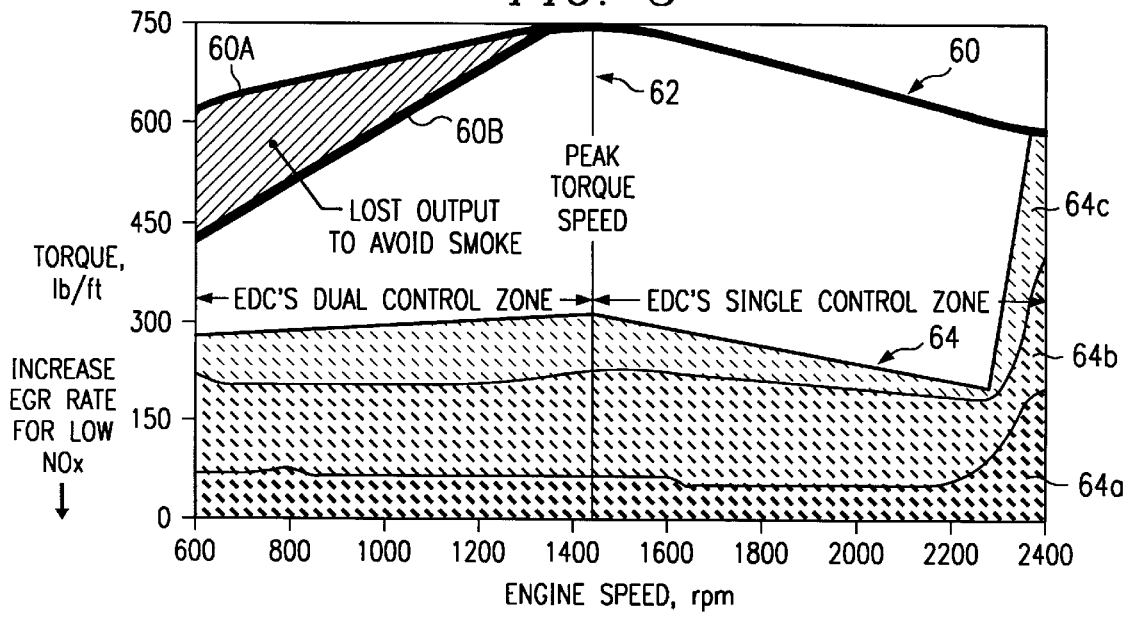
FIG. 3 is a graphical representation showing performance of a typical mid-range heavy-duty turbocharged diesel engine having an exhaust gas recirculation control and power augmentation system incorporating teachings of the present invention.

The preferred embodiments of the present invention and its advantages are best understood by referring to FIGS. 1–4 of the drawings, like numerals being used for like and corresponding parts of the various drawings.

FIG. 1 is a schematic block diagram showing various components associated with internal combustion engine 20, exhaust gas recirculation (EGR) system 40 and engine control module 42. A wide variety of internal combustion engines such as shown in U.S. Pat. Nos. 5,297,515; 5,353,776; and 5,499,605 may be satisfactorily used with the present invention. Each of these patents is incorporated by reference for all purposes in this application.

For many applications, engine 20 will preferably be a heavy-duty turbocharged diesel engine which may frequently be operated above and below the peak torque speed for the associated diesel engine. For other applications, the present invention may be used with a spark ignited turbocharged engine and is not limited to use solely with diesel engines. For example the present invention may be satisfactorily used with turbocharged engines which operate with natural gas, gasoline, hydrogen, propane, butane, alcohol or any other air/fuel mixture.

Exhaust gas recirculation system 40, as shown in FIG. 1, may sometimes be referred to as a high pressure loop (HPL) EGR system. A supply of diesel fuel (not expressly shown) is preferably provided for engine 20. An air intake system (not expressly shown) provides a supply of fresh intake air through filter 22 to compressor 26 of turbocharger 24. A first portion of the exhaust gas exiting from exhaust manifold 30 of engine 20 is also supplied to intake manifold 34. A second portion of the exhaust gas flows through turbine 28 of turbocharger 24 to rotate compressor 26. As a result, intake air exiting from compressor 26 of turbocharger 24 is compressed and heated. The compressed intake air then flows through intercooler 32 to intake manifold 34. The pressure within intake manifold 34 is usually greater than the pressure of exhaust gas exiting from turbine 28. Therefore, one end of exhausted gas recirculation line 36 is preferably connected between exhaust manifold 30 and the input side of turbine 28. The other end of exhaust gas recirculation line 36 is preferably connected with the cooled compressed air flowing out of intercooler 32 prior to intake manifold 34. Exhaust gas recirculation line 36 may be referred to as a high pressure loop EGR line since the pressure in exhaust manifold 30 and EGR line 36 is in many cases higher than the pressure in intake manifold 34. Engine control 42 is provided to control the position of EGR valve 38 which regulates the recirculation flow rate of exhaust gas from exhaust manifold 30 to intake manifold 34 based on engine operating conditions.

For some applications, exhaust gas recirculation systems having a high pressure loop, such as shown in FIG. 1, have proven successful in reducing $NO_x$ emissions from heavy-duty diesel engines to less than two grams per brake horsepower-hour (2.0 g/bhp-hr). When initially used, such high pressure loop EGR systems often resulted in increased fuel consumption and an increase in particulate emissions from the associated diesel engine. Therefore, exhaust gas exiting from turbine 28 of turbocharger 24 preferably flows through filter trap 44 to reduce such particulate emissions. However, diesel engines operating with a high pressure loop EGR system generally have a higher fuel consumption rate due to reduced performance of turbocharger 24 as compared to similar engines operating without a high pressure loop EGR system.

FIG. 2 shows internal combustion engine 20 having exhaust gas recirculation system 140, which may sometimes be referred to as a low pressure loop exhaust gas recirculation (EGR) system. Intake air flows through filter 22 to compressor 26 of turbocharger 24 and through intercooler 32 to intake manifold 34. Exhaust gas flows from exhaust manifold 30 through turbine 28 of turbocharger 24. Since all exhaust gas flows through turbine 28 of turbocharger 24, the performance of turbocharger 24 is maintained and the fuel efficiency of the associated diesel engine will not deteriorate.

For many applications, the exhaust gas will then flow from turbine 28 to filter trap 144. A portion of the exhaust gas exiting from filter trap 144 may then flow through exhaust gas recirculation line 136 to exhaust gas recirculation valve 38. Back pressure valve 146 is preferably provided in the outlet from filter trap 144 downstream from exhaust gas recirculation line 136. For some applications, an optional bypass line 148 may be provided to allow exhaust gas to bypass filter trap 144, exhaust gas recirculation line 136, and back pressure valve 146. Back pressure valve 150 is also provided in bypass line 148 to control the flow of exhaust gas therethrough. Engine control 142 is provided to regulate the opening and closing of exhaust gas recirculation valve 38, back pressure valve 146 and back pressure valve 150 depending upon the operating conditions of the associated engine 20.

The exhaust gas exiting from filter trap 144 is generally at a relatively low pressure in comparison with the pressure within intake manifold 34. Therefore, exhaust gas recirculation line 136 is coupled with the inlet to compressor 26 of turbocharger 24. A heated compressed mixture of intake air and exhaust gas flows from compressor 26 of turbocharger 24 through intercooler 32 to intake manifold 34.

Exhaust gas recirculation cooler 152 is preferably provided between exhaust gas recirculation valve 38 and the inlet to compressor 26 to reduce the temperature of the exhaust gas entering compressor 26. For the embodiment shown in FIG. 2, exhaust gas recirculation cooler 152 receives cooling water from the water cooling system associated with engine 20 and may sometimes be referred to as a "jacket water cooler." Coolant supply line 154 is preferably provided to direct cooling water from engine 20 to exhaust gas recirculation cooler 152. Coolant return line 156 is provided to return cooling water from exhaust gas recirculation cooler 152 to engine 20.

For some applications, exhaust gas recirculation cooler 152 may use cooling air to reduce the temperature of exhaust gas flowing through the associated EGR cooler. U.S. Pat. No. 4,885,911 entitled *Internal Combustion Engine Turbo System and Method* discloses one type of air cooling system which may be satisfactorily used to reduce the temperature of recirculated exhaust gas. The present invention is not limited to use with only EGR coolers having a liquid such as water and/or antifreeze flowing therethrough.

During most operating conditions associated with engine 20, the difference in pressure between the outlet of filter trap 144 and the inlet to compressor 26 of turbocharger 24 will be adequate for sufficient exhaust gas recirculation flow rates to reduce $NO_x$ emissions to levels of two grams per brake horsepower-hour (2.0 g/bhp-hr) or less.

Low pressure loop exhaust gas recirculation system 140, as shown in FIG. 2, will typically result in lower fuel consumption as a result of better turbocharger performance in comparison with a high pressure loop exhaust gas recirculation system 40 of FIG. 1. Since filter trap 144 will typically remove more than ninety percent (90%) of particulate contamination from the exhaust gas before entering low pressure loop EGR line 136, component wear in engine 20 is reduced and engine life increased over corresponding high pressure loop EGR. Exhaust gas exiting from filter trap 144 and entering exhaust gas recirculation line 136 is generally cooler than exhaust gas exiting from upstream of turbine 28 of turbocharger 24 in exhaust gas recirculation system 40. Therefore, a low pressure loop exhaust gas recirculation system, such as shown in FIG. 2, generally has a higher heat absorbing capacity as compared with a high pressure loop exhaust gas recirculation system shown in FIG. 1. Also, exhaust gas cooler 152 may be substantially reduced in size to provide a more compact unit. Reducing the amount of exhaust gas recirculation cooling may also help to prevent exhaust gas condensation and potential erosion within compressor 26 of turbocharger 24. Combining both intake air and recirculated exhaust gas within compressor 26 of turbocharger 24 results in better mixing of the combined intake air/recirculated exhaust gas within intake manifold 34.

A low pressure loop exhaust gas recirculation system, such as shown in FIG. 2, also has some disadvantages. For some applications, the exhaust gas pressure present at the outlet from filter trap 144 may not be high enough to provide sufficient exhaust gas recirculation flow rates to significantly reduce $NO_x$ emissions. Therefore, back pressure valve 146 may be required to develop sufficient differential pressure across exhaust gas recirculation valve 138 to provide required exhaust gas flow rates from filter trap 144 to the inlet of compressor 26.

The efficiency of turbocharger 24 is generally reduced due to the higher temperature of recirculated exhaust gas at the inlet to compressor 26. A low pressure loop exhaust gas recirculation system, as shown in FIG. 2, may require additional components such as one or more back pressure valves, an exhaust gas recirculation cooler and more extensive piping or ducting as compared to a high pressure loop exhaust gas recirculation system. These additional components further complicate assembly and maintenance of engine 20.

FIG. 3 is a graphical representation of operating characteristics for a typical medium range heavy-duty turbocharged diesel engine having an exhaust gas recirculation control and power augmentation system incorporating teachings of the present invention. Line 60 corresponds with the full load torque that may be produced by the typical medium range heavy-duty turbocharged diesel engine at various engine speeds. For this example, the peak torque load occurs at a speed of approximately 1450 revolutions per minute (RPM) and is indicated as peak torque speed line 62.

When a diesel engine operates at speeds below its associated peak torque speed and with an open throttle to accommodate a heavy load, excessive amounts of smoke will frequently be emitted in the exhaust gas. Low rotational speed of the associated turbocharger will generally not provide the intake manifold with sufficient boost pressure required for good free smoke combustion of the diesel fuel. Line segment 60A indicates the output limit of a typical turbocharged diesel engine when no limits are imposed on the fuel rate to reduce smoke emissions.

Various control devices such as "puff limiters", aneroids and/or other boost control devices have frequently been added to turbocharged diesel engines to reduce fuel rates at speeds below the peak torque speed, and therefore, limit smoke emissions by limiting the output of the associated diesel engine. Line segment 60B is representative of the smoke limited output of a medium range heavy-duty turbocharged diesel engine. Heavy exhaust smoke emissions are typically observed when a diesel engine operates between line segments 60A and 60B.

Diesel engines operating at low speeds and with little or no engine load generally operate very satisfactorily with relatively high exhaust gas recirculation flow rates because the air/fuel ratio under these operating conditions is very high (75:1 or greater). A diesel engine operating at its associated peak torque speed may have an air/fuel ratio of approximately 25:1. At rated speed, full load engine conditions, a typical air/fuel ratio for a medium range heavy-duty diesel engine is approximately 30:1. Therefore, the volume or flow rate of recirculated exhaust gas is generally decreased as engine operating conditions approach these limits to avoid formation of smoke in the exhaust gas emissions from the associated engine.

Line 64 represents the typical effective limit for exhaust gas recirculation to reduce $NO_x$ emissions without increasing smoke emissions from unburned fuel. The shaded area below EGR effective limit line 64 is generally proportional to the exhaust gas recirculation flow rate required for significant reduction of $NO_x$ emissions. Darker portion 64*a* represents increased EGR flow rates associated with low engine load or low torque operation of the associated diesel engine. Medium dark portion 64*b* indicates reduced EGR flowrates as engine torque increases. Light portion 64*c* represents further reduced EGR flowrates as engine torque approaches EGR effective limit line 64. For a typical diesel engine, the exhaust gas recirculation rate will increase to maintain low $NO_x$ emission as the load or torque placed on the engine decreases.

Figure 4:
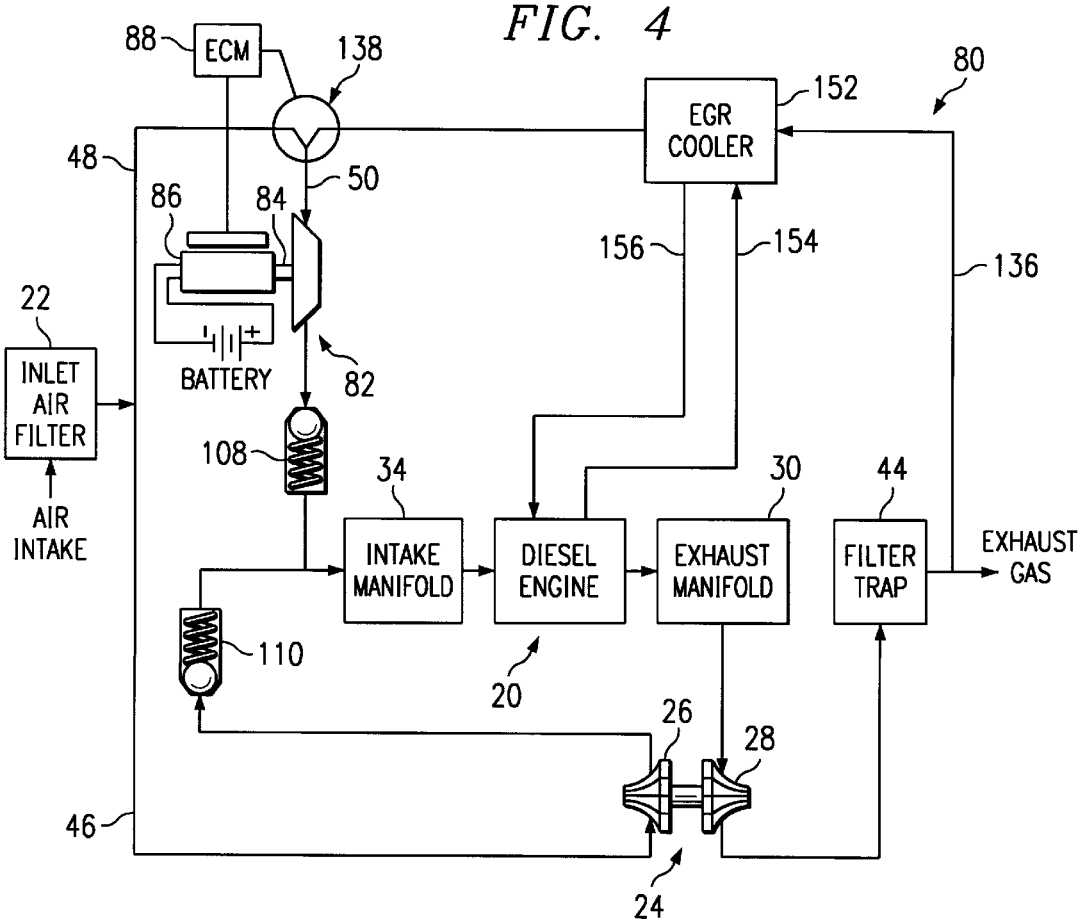
FIG. 4 is a schematic drawing showing a block diagram of various components associated with a typical heavy-duty diesel engine having an exhaust gas recirculation control and power augmentation system which includes an electrically controlled diverter valve and an electrically driven compressor in accordance with teachings of the present invention.

Exhaust gas recirculation control and power augmentation system 80 incorporating teachings of the present invention is shown in FIG. 4. Various components of exhaust gas recirculation system 40 and 140 are also included in exhaust gas recirculation control and power augmentation system 80. All ducting and piping associated with exhaust gas recirculation control and power augmentation system 80 is preferably sized and routed to avoid excessive bends and joints. EGR control and power augmentation system 80 is preferably designed to minimize any potential exhaust gas leaks under a variety of extreme engine operating conditions. Exhaust gas preferably flows from diesel engine 20 through exhaust manifold 30 to turbine 28 of turbocharger 24. All exhaust gas exiting from turbine 28 is preferably directed through filter trap 44 to eliminate or substantially reduce particulate matter. For some applications, filter trap 44 may periodically incinerate particulate matter in a diesel particulate filter system. Such periodic or active regeneration filter traps may include electrical heaters or an igniter and a supply of air to intermittently burn carbon removed from the exhaust gas.

For other applications, filter trap 44 may be passively regenerated by processes such as continuous catalytic oxidation of particulate matter through the use of organometallic compounds which are added to the fuel to reduce the ignition temperature of carbon removed from the exhaust gas. A wide variety of passive and active filter traps associated with diesel engine exhaust after treatment are commercially available and may be satisfactorily used with the present invention. Catalytic converters may be satisfactorily used when the present invention is combined with engines that operate on various types of fuels, other than diesel, which do not produce soot.

A first portion of the exhaust gas exiting from filter trap 44 will then flow through exhaust gas recirculation line 136 and EGR cooler 152 to electronically controlled diverter valve 138. Reducing the temperature of recirculated exhaust gas passing through EGR cooler 152 increases the density of exhaust gas and therefore density of the intake air/exhaust gas mixture supplied to intake manifold 34 to improve specific power output of engine 20 and maximize the effectiveness of exhaust gas recirculation to reduce $NO_x$ emissions.

Intake air from inlet filter 22 is directed to compressor 26 of turbocharger 24 through first air flowline 46. Intake air from inlet filter 22 is also directed to electronically controlled diverter valve 138 through second air flowline 48. Electronically controlled diverter valve 138 receives both cool, filtered recirculated exhaust gas from EGR cooler 152 and fresh intake air from filter 22. The ratio of recirculated exhaust gas and fresh intake air exiting from electronically controlled diverter valve 138 may be determined by an appropriate $NO_x$ reduction algorithm based on the required exhaust gas recirculation rate needed to produce the desired level of $NO_x$ emissions for a given set of engine operating conditions. Outlet 50 of electronically controlled diverter valve 138 is coupled with the inlet to electrically driven compressor 82. Electronically controlled diverter valves satisfactory for use with the present invention can be made from existing exhaust gas recirculation (EGR) valves such as EGR valves associated with Caterpillar "*Low Emission* 3208 *Engine with Exhaust Gas Recirculation.*"

When diesel engine 20 is operating at speeds below peak torque speed 62 while the load on diesel engine 20 increases, electronically controlled diverter valve 138 will gradually reduce the flow rate of recirculated exhaust gas and increase the proportion of intake air exiting from diverter valve 138. At full load conditions represented by maximum torque line 60B, essentially 100% intake air is supplied to electrically driven compressor 82 from electronically controlled diverter valve 138. Under full load operating conditions represented by line segment 60B, electrically driven compressor 82 functions in its power augmentation mode by supply intake air which reduces excessive smoke and provides better fuel consumption efficiency for engine 20. Thus, the combination of electronically controlled diverter valve 138 and electrically driven compressor 82 can control both the exhaust gas recirculation flow rate and smoke limited power output at speeds below peak torque speed 62.

When diesel engine 20 operates above peak torque speed 62, turbocharger 24 is generally able to provide sufficient quantities of intake air to substantially reduce or eliminate any smoke in the exhaust gas. Therefore, when diesel engine 20 operates at speeds above peak torque speed 62, electronically controlled diverter valve 138 will generally only supply recirculated exhaust gas to electrically driven compressor 82 to reduce $NO_x$ emissions when the load on diesel engine 20 is below line 64.

Check valves 108 and 110 are preferably arranged to control the flow of intake air and recirculated exhaust gas into intake manifold 34 to prevent backflow through either turbocharger 24 or electrically driven compressor 82. When engine 20 operates at speeds below peak torque speed 62, a mixture of intake air and recirculated exhaust gas are supplied through diverter valve 138, electrically driven compressor 82, and check valve 108 to intake manifold 34. When diesel engine 20 operates at load conditions above line 64 and speeds above peak torque speed 62, generally all of the required intake air is supplied from compressor 26 of turbocharger 24 through check valve 110 to intake manifold 34.

Electrically driven compressor 82 is attached by shaft 84 to electrical motor 86. For some applications, electrically driven compressor 82 and compressor 26 of turbocharger 24 may have a similar configuration. When the speed of diesel engine 20 accelerates or when diesel engine 20 is operating at low engine speeds, electronic control module 88 will provide an electrical signal to increase the speed of electrical motor 86. The rotational speed of compressor 82 will increase and provide additional boost pressure to intake manifold 34. Electronic control module 88 will also send a signal to direct more intake air from filter 22 through electronically controlled diverter valve 138 to electrically driven compressor 82. As a result, the performance of diesel engine 20 will substantially improve during acceleration from low speed conditions and during low speed high power output conditions. As the speed of diesel engine 20 increases, especially above peak torque speed 62, turbocharger 24 will develop a relatively high boost pressure which overcomes the outlet pressure from electrically driven compressor 82.

Generally electrically driven compressor 82 will function as a power augmentation device only at low speeds below peak torque speed. At speeds above peak torque speed the efficiency and output from turbocharger 24 provides sufficient intake air flow to manifold 34. Electronically controlled diverter valve 138 and electrically driven compressor 82 cooperate with each other to supply recirculated exhaust gas to intake manifold 34 whenever diesel engine 20 is operating at low load conditions below exhaust gas rate recirculation line 64 as shown in FIG. 3. Various types of electrically driven compressors may be satisfactorily used with the present invention.

Turbodyne Systems, Inc. with offices located in Vancouver, British Columbia and Carpinteria, Calif. offers an electronic demand charger (EDC) which incorporates an electrical motor with a compressor to provide increased air flow at low engine operating speeds. U.S. Pat. No. 5,605,045 entitled *Turbocharging System With Integral Assisting Electric Motor and Cooling System Therefor* provides one example of an electrically driven compressor. U.S. Pat. No. 5,560,208 entitled *Motor-Assisted Variable Geometry Turbocharging System* provides another example of a turbocharger having an electrical motor as a part thereof. Both of these patents are incorporated by reference for all purposes in this application.

When diesel engine 20 is operating at low speeds and full engine load conditions such as when diesel engine 20 is accelerating from a low speed condition, electrical motor 86 will rotate compressor 82 to provide additional intake air from filter 22 through electronic control diverter valve 138, electrically driven compressor 82 and check valve 108 to intake manifold 34. Thus, reducing smoke emissions during acceleration of engine 20 from low speed no load to high speed, high load conditions or during low speed heavy load conditions.

When diesel engine 20 operates below peak torque speed 62 electronically controlled diverter valve 138 and electrically driven compressor 82 cooperate with each other to provide exhaust gas recirculation control and to provide power augmentation for diesel engine 20. When diesel engine 20 operates at speeds above peak torque speed 62, electronically controlled diverter valve 138 and electrically driven compressor 82 function primarily to control exhaust gas recirculation flow rates to reduce $NO_x$ concentration levels.

The teachings of the present invention may be incorporated as part of a wide variety of engine control modules or systems such as shown in U.S. Pat. No. 5,524,599 entitled *Fuzzy Logic Air/Fuel Controller;* U.S. Pat. Nos. 5,284,116; 5,123,397; and 4,945,870, all entitled *Vehicle Management Computer.* Electronic control module 88 preferably includes at least one processor for calculating air/fuel ratios and intake air/exhaust gas recirculation ratios in accordance with teachings of the present invention. Electronic control module 88 may also include at least one storage means having desired engine operating parameters such as desired air/fuel ratios, exhaust gas recirculation flow rates, and allowable $NO_x$ emission rates, corresponding with various engine operating conditions such as engine speed and torque load.

Although the present invention has been described in great detail, it should be understood that various changes, substitutions and alterations can be made hereto without departing from the spirit and scope of the invention as defined by the appended claims.

What is claimed is:

1. An exhaust gas recirculation control and power augmentation system for an internal combustion engine having an intake manifold and an exhaust manifold comprising:

a turbocharger having a compressor for supplying intake air to the intake manifold and a turbine which receives exhaust gas from the exhaust gas manifold to operate the compressor;

the turbine having an outlet coupled with a filter trap whereby exhaust gas exiting from the turbine will flow through the filter trap to substantially reduce particulate matter in the exhaust gas;

an exhaust gas recirculation line extending from the outlet of the filter trap to an electronically controlled diverter valve;

an intake air system having a first air flowline to supply intake air to the compressor of the turbocharger and a second air flowline to supply intake air to the electronically controlled diverter valve;

the electronically controlled diverter valve having a first inlet to receive recirculated exhaust gas from the exhaust gas recirculation line and a second inlet to receive intake air from the second air flowline;

the electronically controlled diverter valve having an outlet coupled with an electrically driven compressor whereby the electronically controlled diverter valve controls the volume and ratio of recirculated exhaust gas and intake air supplied to the electrically driven compressor; and the electrically driven compressor having an outlet connected with the intake manifold to supply a mixture of recirculated exhaust gas and intake air to the intake manifold.

2. The system of claim 1 further comprising a continuously regenerating filter trap.

3. The system of claim 1 wherein the internal combustion engine further comprises a diesel engine.

4. The system of claim 1 further comprising:

a first check valve disposed in a flowline extending from the outlet of the electrically driven compressor to the intake manifold to allow the mixture of intake air and recirculated exhaust gas to flow in our direction from the electrically driven compressor to the intake manifold and to block the flow of the mixture of intake air and recirculated exhaust gas from the intake manifold to the electrically driven compressor; and a second check valve disposed in a flowline extending from the compressor of the turbocharger to the intake manifold to allow intake air to flow in one direction from the compressor of the turbocharger to the intake manifold and to block the flow of intake air from the intake manifold to the compressor of the turbocharger.

5. The system of claim 1 comprising:

the electrically driven compressor providing boost pressure to the intake manifold; and the compressor of the turbocharger providing boost pressure to the intake manifold.

6. The system of claim 1 further comprising the electronically controlled diverter valve cooperating with the electrically driven compressor to control the flow rate of recirculated exhaust gas supplied to the intake manifold to maintain $NO_x$ emissions from the internal combustion engine below a selected level.

7. The system of claim 1 further comprising:

an exhaust gas recirculation cooler disposed in the exhaust gas recirculation line between the outlet of the filter trap and the first inlet of the electronically controlled diverter valve; and a supply of cooling fluid flowing through the exhaust gas recirculation cooler to reduce the temperature of the recirculated exhaust gas supplied to the electronically controlled diverter valve to improve the efficiency of the associated internal combustion engine when operating at low speeds.

8. The system of claim 1 further comprising the electrically driven compressor supplying recirculated exhaust gas to the intake manifold when the pressure of the exhaust gas existing from the filter trap is less than the intake manifold pressure.

9. The system of claim 1 further comprising an engine control module which provides a signal to the electronically controlled diverter valve to vary the ratio of recirculated exhaust gas and intake air supplied to the electrically driven compressor in response to the torque load and engine speed of the internal combustion engine.

10. The system of claim 1 further comprising an engine control module providing a signal to the electrically driven compressor to control the volume of recirculated exhaust gas and intake air supplied to the intake manifold in response to the actual speed of the internal combustion engine and the torque load on the internal combustion engine.

11. An exhaust gas recirculation control and power augmentation system for a heavy-duty diesel engine having an intake manifold and an exhaust manifold comprising:

a turbocharger having a compressor for supplying intake air to the intake manifold connected with a turbine which receives exhaust gas from the exhaust gas manifold to operate the compressor;

the turbine having an outlet coupled with a filter trap whereby exhaust gas exiting from the turbine will flow through the filter trap to substantially reduce particulate matter in the exhaust gas;

an exhaust gas recirculation line extending from the outlet of the filter trap to an electronically controlled diverter valve;

an intake air filter having a first air flowline to supply intake air to the compressor of the turbocharger;

a second air flowline extending from the intake air filter to supply intake air to the electronically controlled diverter valve;

the electronically controlled diverter valve having a first inlet to receive recirculated exhaust gas from the exhaust gas recirculation line and a second inlet to receive intake air from the second air flowline;

the electronically controlled diverter valve having an outlet coupled with an electrically driven compressor whereby the electronically controlled diverter valve controls the volume and ratio of recirculated exhaust gas and intake air supplied to the electrically driven compressor; and the electrically driven compressor having an outlet connected with the intake manifold to supply a mixture of recirculated exhaust gas and intake air to the intake manifold.

12. The system of claim 11 further comprising:

all exhaust gas exiting from the turbine of the turbocharger flowing through the filter trap; and a portion of the exhaust gas exiting from the filter trap flowing through the exhaust gas recirculation line to an exhaust gas recirculation cooler.

13. The system of claim 11 further comprising:

a first check valve disposed in a flowline extending from the outlet of the electrically driven compressor to the intake manifold to allow the mixture of intake air and recirculated exhaust gas to flow in one direction from the electrically driven compressor to the intake manifold and to block the flow of the mixture of intake air and recirculated exhaust gas from the intake manifold to the electrically driven compressor; and a second check valve disposed in a flowline extending from the compressor of the turbocharger to the intake manifold to allow intake air to flow in one direction from the compressor of the turbocharger to the intake manifold and to block the flow of intake air from the intake manifold to the compressor of the turbocharger.

14. The system of claim 11 further comprising the electronically controlled diverter valve cooperating with the electrically driven compressor to control the flow rate of recirculated exhaust gas supplied to the intake manifold to maintain $NO_x$ emissions from the internal combustion engine below a selected level.

15. The system of claim 11 further comprising the electrically driven compressor supplying recirculated exhaust gas to the intake manifold when the pressure of the exhaust gas existing from the filter trap is less than the intake manifold pressure.

16. A method for controlling exhaust gas recirculation and power augmentation of a diesel engine having a turbocharger, an intake manifold and an exhaust manifold comprising:

supplying intake air to a compressor portion of the turbocharger;

supplying intake air to an electronically controlled diverter valve;

directing exhaust gas from the exhaust gas manifold to a turbine portion of the turbocharger;

filtering exhaust gas exiting from the turbine portion of the turbocharger and directing a first portion of the filtered exhaust gas to the electronically controlled diverter valve;

mixing the first portion of the filtered exhaust gas with the intake air supplied to the electronically controlled diverter valve;

directing the mixture of filtered exhaust gas and intake air from the electronically controlled diverter valve to an electrically driven compressor;

discharging the mixture of filtered exhaust gas and intake air from the electrically driven compressor to the intake manifold; and adjusting the ratio of intake air and filtered exhaust gas exiting from the electronically controlled diverter valve based in part on the speed of the engine and desired $NO_x$ emission level.

17. The method of claim 16 wherein the step of adjusting the ratio of intake air and filtered exhaust gas exiting from the electronically controlled diverter valve further comprises:

measuring the engine speed;

measuring the torque load on the engine; and calculating a desired ratio of filtered exhaust gas and intake air supplied to the diesel engine.

18. The method of claim 16 further comprising:

discharging the mixture of filtered exhaust gas and intake air from the electrically driven compressor through a first check valve which allows the mixture to flow in only one direction from the electronically driven compressor to the intake manifold; and directing intake air discharged from the compressor portion of the turbocharger through a second check valve which allows the intake air to flow in only one direction from the compressor portion of the turbocharger to the intake manifold.

19. The method of claim 16 further comprising:

measuring the operating speed of the diesel engine;

comparing the operating speed of the diesel engine with a peak torque speed associated with the diesel engine; and supplying intake air from the electronically controlled diverter valve to the electrically driven compressor when the operating speed of the diesel engine is less than the associated peak torque speed.

20. The method of claim 16 further comprising:

producing a signal representative of the desired $NO_x$ content in the exhaust gas discharged from the diesel engine;

producing a signal representative of the actual speed of the diesel engine;

producing a signal representative of the actual torque load on the diesel engine;

comparing the signal representative of the desired $NO_x$ content in the exhaust gas with the respective signals representative of the actual torque load and the actual engine speed in an engine control module; and producing an output signal from the engine control module to control the electronically controlled diverter valve and the electrically driven compressor to provide a desired mixture of filtered exhaust gas and intake air to the intake manifold.

* * * * *